United States Patent [19]

Stangl

[11] Patent Number: 4,883,720

[45] Date of Patent: Nov. 28, 1989

[54] PROCESS OF MARKING HOT STEEL INGOTS AND PRODUCT

[76] Inventor: Kurt Stangl, A-4844, Regau 106, Austria

[21] Appl. No.: 333,448

[22] Filed: Apr. 5, 1989

[30] Foreign Application Priority Data

Apr. 13, 1988 [AT] Austria ..... 953/88

[51] Int. Cl.[4] ..... G22F 3/00

[52] U.S. Cl. ..... 428/552; 428/564; 419/9; 427/199; 106/19; 118/697

[58] Field of Search ..... 427/53.1, 343, 438, 427/199, 197; 428/570; 106/19; 118/697; 419/9; 40/629

[56] References Cited

U.S. PATENT DOCUMENTS

| | | | |
|---|---|---|---|
| 4,281,035 | 7/1981 | Hawthorne et al. | 427/199 |
| 4,538,546 | 9/1985 | Baron | 118/697 |
| 4,623,561 | 11/1986 | Groothuizen | 427/275 |

*Primary Examiner*—Stephen J. Lechert, Jr.
*Attorney, Agent, or Firm*—Kurt Kelman

[57] ABSTRACT

For the provision of durable and easily legible inscriptions by jet spraying on steel ingots when they are at an elevated temperature, a nickel or iron metal powder having a largest particle dimension not in excess of 0.075 mm and a zirconium oxide powder or aluminum oxide powder having a largest particle dimension not in excess of 0.075 mm and used in an amount that is not in the excess of 10% by weight of the metal powder are jointly sprayed onto the surface of the steel ingots to form dots or lines thereon.

17 Claims, No Drawings

PROCESS OF MARKING HOT STEEL INGOTS AND PRODUCT

BACKGROUND OF THE INVENTION

1. Field of the Invention

This invention relates to a process of marking hot steel ingots with dots or lines wherein a metallic material which does not exert an adverse effect on the desired properties of the steel is applied to the ingot by jet spraying.

2. Description of the Prior Art

In order to mark steel ingots, they may be provided with inscriptions immediately after they have been made, e.g., in a continuous casting plant. Considerable difficulties are involved in such marking operations because the steel ingots are to be marked when their surfaces are at a very high temperature of 800° C., on an average. Whereas paints might be sprayed onto the surface of the ingot in the form of dots, such paints have a thermal stability only up to temperatures in the range of that surface temperature. Besides, the paint spray nozzles used to spray such paints tend to be clogged at the temperatures which are encountered so that the reliability in operation is highly reduced.

In order to avoid these disadvantages it has already been suggested to apply a metallic material rather than paint in the form of dots or lines to the hot surface of the block and to apply said metallic material by a flame spraying process in which the material is supplied in the form of a wire to a spray gun and is melted in said gun and is then atomized by means of compressed air and sprayed onto the steel ingots to be marked. Whereas the flame spraying of an aluminum wire has proved satisfactory as a process of marking steel surfaces which are cold or at moderately elevated temperatures, aluminum wire cannot be used to mark steel ingots having surface temperatures of or above about 600° C. because aluminum that has been sprayed onto surfaces at a higher temperature will flow on the surface and will evaporate in part from the surface.

Whereas the temperature stability of the marking material might be increased by the use of high-melting metallic marking materials, such as nickel wire or titanium wire, such materials cannot be used in most cases because the colors of the oxides of said materials which are formed on the surface of the ingot hardly differ from the color of the iron oxide which constitutes the scale that is present on the surface of the ingot so that the inscriptions which are thus provided will hardly be legible. It has been attempted to avoid said disadvantages by the flame spraying of bronze or brass wire, which can be used to provide durable inscriptions on steel ingots even when the inscriptions are applied to surfaces at highly elevated temperatures. But such attempts have not been successful in practice because the copper that is contained in such alloys will considerably increase the susceptibility of the steel of red brittleness so that surface cracks may be formed on the steel ingots during their subsequent processing, e.g., by rolling or forging.

SUMMARY OF THE INVENTION

It is an object of the invention to avoid the disadvantages outlined hereinbefore and so to improve by the use of simple means a process of the kind described first hereinbefore that durable and clearly legible inscriptions can be provided on steel ingots even when the latter are at relatively high surface temperatures as the inscriptions are applied.

That object is accomplished in accordance with the invention in that the metallic marking material consists of a nickel metal powder or iron metal powder which has a largest particle dimension not in excess of 0.075 mm and is applied by jet spraying together with a zirconium oxide powder or aluminum oxide powder which has a largest particle dimension not in excess of 0.075 mm and is used in an amount that is not in excess of 10% of the amount of the metal powder.

The marking of hot steel ingots by a powder spraying process which is known per se affords the advantage that the materials which are employed need not constitute a deformable alloy as is the case with wires used for jet spraying. As a result, it is possible to use also oxides in a color which differs from that of iron oxide. Because the zirconium oxide or aluminum oxide which is used is stable at the existing surface temperatures of the steel ingots and has a color which contrasts with the color of iron oxide, it is possible to impart a permanently visible color to the metallic material which is applied by spraying to form dots or lines and that metallic material may consist of nickel or iron which otherwise would not be suitable for that purpose and which has a melting point that distinctly exceeds the usual surface temperature of the steel ingot at the time when the inscriptions are to be applied. It will be necessary, however, to ensure the formation of a sufficiently strong bond between the metallic material which has been sprayed onto the ingot and the simultaneously sprayed zirconium oxide or aluminum oxide and special measures must be adopted to ensure such a strong bond. It has been found that when the two marking materials are applied byjet spraying, the desired strong bond between the two marking materials will not be ensured unless said two components of the marking material are applied to the spray gun in the form of powders having a largest particle dimension not in excess of 0.075 mm and the amount of the zirconium oxide or aluminum oxide is not in excess of 10% by weight of the metallic component. It is believed that the powders must have a very large surface area per unit of volume if the surface portions of the particles of zirconium oxide or aluminum oxide which have been incipiently melted during the jet spraying are to form durable bonds with the also incipiently molten surfaces of the metal powder particles. But because the use of powders having the properties stated will restrict an incorporation of the zirconium oxide or aluminum oxide in the matrix which is constituted by the sprayed-on metal powder, a limit is imposed as regards the amount in which the zirconium oxide powder or aluminum oxide powder which may be sprayed together with the metal powder.

The nickel powder which is employed may consist of a commercially available nickel powder, which contains at least 98% by weight pure nickel. Commercially available iron powders usually contain at least 95% by weight pure iron. Commercially available zirconium oxide powders contain at least 65% by weight $ZrO_2$, balance CaO. Commercially available aluminum oxide powders may be expected to contain 95% by weight $Al_2O_3$. Such commercially available powders may desirably be used at the stated weight ratio to mark steel ingots in that the powders are blown by means of oxygen gas in a spray gun through an acetylene flame. For that purpose the oxygen gas is supplied to the spray gun under a gage pressure of usually 1.5 bars. The acetylene gas is supplied to the spray gun under a gage pressure of about 0.5 bar. The distance from the tip of the spray gun to the surface on which the steel ingot is to be marked should exceed by at least 10 mm the length of the acetylene-oxygen flame which emerges from the spray gun. It is believed that said distance should sufficiently exceed the length of the flame to ensure that the surfaces of the powder particles will be incipiently melted before they reach the surface of the ingot. If the distance between the tip of the flame and the surface of the steel ingot is between 10 and 20 mm, desirable results will be produced as regards the strength of the resulting bond and as regards the thickness of the layer which constitutes the inscription. Whereas a flame spraying using an acetylene flame is believed to be highly satisfactory, an electric arc might alternatively be used to incipiently melt the powder particles because the manner in which the hot jet is formed will not be essential for the desired result. It will also not be significant if the pulverulent components are separately supplied to the spray gun or are blended before they are supplied to the spray gun.

In order to ensure particularly desirable conditions as regards the proportions in which the powders are employed the powder consisting of zirconium oxide or aluminum oxide which is sprayed together with the metal powder should not be in excess of 5% by weight of the metal powder. In practice, the use of 97% by weight commercially available nickel powder and 3% by weight commercially available zirconium oxide powder has been found to be desirable for most applications.

In addition, an aluminum powder not in excess of 2% by weight of the nickel or iron powder may be admixed to the latter in order to improve the bond between the inscription and the surface of the steel ingot. In that case the low-melting aluminum powder will act as a coupling agent and it must be taken into account that part of the aluminum will burn at surface temperatures of about 800° C. and the resulting heat will desirably assist the sinter-bonding of the high-melting metal powder to the surface of the steel ingot.

The steel ingots which have been marked by the process in accordance with the invention are provided with a marking comprising a metallic material which is selected from the group consisting of iron and nickel and is sinter-bonded to said surface and an oxide material which is selected from the group consisting of aluminum oxide and zirconium oxide and is sinter-bonded to said metallic material and present in an amount that is not in excess of 10% by weight of said metallic material.

I claim:

1. In a process of marking steel ingots with a metallic material which is applied by jet spraying to surfaces of the ingots while said surfaces are at an elevated temperature, the improvement residing in that said metallic material is selected from the group consisting of iron and nickel in the form of a powder which has a largest particle dimension not in excess of 0.075 mm and an oxide material which is selected from the class consisting of zirconium oxide and aluminum oxide and used in the form of a powder having a largest particle dimension not in excess of 0.075 mm and in an amount not in excess of 10% by weight of said metallic material is applied to said surfaces of said ingots by jet spraying together with said metallic material.

2. The improvement set forth in claim 1 as applied to a process in which said steel ingot is marked with dots.

3. The improvement set forth in claim 1 as applied to a process in which said ingot is marked with lines.

4. The improvement set forth in claim 1, wherein said oxide material is applied to said surfaces by jet spraying in an amount that is not in excess of 5% by weight of the metal powder.

5. The improvement set forth in claim 1, wherein said metallic material and said oxide material are applied to said surfaces by jet spraying in the form of commercially available powders.

6. The improvement set forth in claim 1, wherein said metallic material and said oxide material are applied by jet spraying to said surfaces of said ingots while said surfaces are at a temperature in excess of 600° C.

7. The improvement set forth in claim 1, wherein said powders of said metallic material and of said oxide material are merely incipiently melted as they are applied by jet spraying to said surfaces of said ingots.

8. The improvement set forth in claim 7, wherein said powders of said metallic material and of said oxide material are incipiently melted before they reach said surfaces.

9. The improvement set forth in claim 1, wherein said powders of said metallic material and of said oxide material are applied to said surfaces by jet spraying using a flame.

10. The improvement set forth in claim 9, wherein said powders of said metallic material and of said oxide material are applied to said surfaces by jet spraying using an oxyacetylene flame.

11. The improvement set forth in claim 1, wherein said powders of said metallic material and of said oxide material are applied to said surfaces by jet spraying using a flame having a tip which is spaced at least 10 mm from said surfaces.

12. The improvement set forth in claim 9, wherein said flame has a tip which is spaced 10 to 20 mm from said surfaces.

13. The improvement set forth in claim 1, wherein said powders of said metallic material and of said oxide material are applied to said surfaces by jet spraying using a plasma jet that is produced by an electric arc.

14. The improvement set forth in claim 1, wherein said metallic material additionally contains aluminum powder in an amount that is not in excess of 2% by weight of said metallic material.

15. The improvement set forth in claim 14, wherein said metallic material and said oxide material are applied by jet spraying to said surfaces of said ingots while said surfaces are set at a temperature of at least 800° C.

16. The improvement set forth in claim 1, wherein said surfaces of said ingots to which said metallic material and said oxide material have been applied by jet spraying are maintained at sufficiently high temperatures for a sufficiently long time to sinter-bond said metallic material to said surfaces.

17. A steel ingot which is provided on its surface with a marking comprising a metallic material which is selected from the group consisting of iron and nickel and is sinter-bonded to said surface and an oxide material which is selected from the group consisting of aluminum oxide and zirconium oxide and is sinter-bonded to said metallic material and present in an amount that is not in excess of 10% by weight of said metallic material.

* * * * *